US008413975B2

(12) United States Patent
Yuan et al.

(10) Patent No.: US 8,413,975 B2
(45) Date of Patent: Apr. 9, 2013

(54) METHOD FOR MAKING AN AUTOMATIC ALBUM

(75) Inventors: Weijun Yuan, Guangdong (CN); Xiaoqiang Zhang, Guangdong (CN); Yiqiang Deng, Guangdong (CN)

(73) Assignee: Imetto Digital Imaging Technology Co., Ltd., Guangdong (CN)

( * ) Notice: Subject to any disclaimer, the term of this patent is extended or adjusted under 35 U.S.C. 154(b) by 0 days.

(21) Appl. No.: 12/863,397

(22) PCT Filed: Aug. 6, 2008

(86) PCT No.: PCT/CN2008/071892

§ 371 (c)(1),
(2), (4) Date: Aug. 10, 2010

(87) PCT Pub. No.: WO2010/000114

PCT Pub. Date: Jan. 7, 2010

(65) Prior Publication Data

US 2011/0088835 A1 Apr. 21, 2011

(30) Foreign Application Priority Data

Jul. 2, 2008 (CN) ..... 2008 1 0029215

(51) Int. Cl.
*B42C 9/00* (2006.01)
*B42C 11/00* (2006.01)

(52) U.S. Cl. ..... 270/45; 270/32; 156/226; 156/227; 156/267; 156/387; 156/443

(58) Field of Classification Search ..... 270/32, 270/45, 51, 52.18, 58.08; 412/4, 8, 14, 18, 412/25, 37; 156/226, 227, 267, 287, 443
See application file for complete search history.

(56) References Cited

U.S. PATENT DOCUMENTS 5,702,219 A 12/1997 Hattori
6,394,730 B1 * 5/2002 Manico et al. ..... 412/9
6,435,562 B1 8/2002 McIntyre et al.
2005/0253321 A1 11/2005 Kimura et al.
2008/0049247 A1 * 2/2008 Asai et al. ..... 358/1.15
2008/0267735 A1 * 10/2008 Hama ..... 412/37
2009/0062096 A1 * 3/2009 Sasahara ..... 493/396

FOREIGN PATENT DOCUMENTS

CN 2147091 Y 11/1993
CN 1158300 A 9/1997
CN 1297819 A 6/2001
CN 1665687 A 9/2005
CN 101314296 A 12/2008
JP 07-025183 A 1/1995
JP 07-223386 A 8/1995

* cited by examiner

*Primary Examiner* — Leslie A Nicholson, III
(74) *Attorney, Agent, or Firm* — Sughrue Mion, PLLC

(57) ABSTRACT

The present invention relates to a method for making an album in a full-automatic way, comprising the steps below: feed the album paper into a creasing machine piece by piece; crease the album paper in the middle and then transfer the album paper to a folding mechanism; fold the album paper along the middle seam and transfer the album paper to a pasting mechanism; select automatic pasting process according to the album making command, when an interlayer is not required, apply the adhesive on one external side of the album paper, align with the other external side of the previous piece of the album paper that is without the adhesive coating, and so forth, so that all the album paper is bonded together to form the album core; when an interlayer is required, feed the pasting mechanism between the album paper and the interlayer, apply the adhesive on one side of the interlayer, paste it with the external side of the previous piece of the album paper, apply the adhesive on one external side of the next piece of the album paper, paste it with the other side of the interlayer, paste the album paper and the interlayer by alignment, feed another piece of the interlayer, and so forth, so that all the album paper and the interlayer are bonded alternately to form the album core.

9 Claims, 3 Drawing Sheets

METHOD FOR MAKING AN AUTOMATIC ALBUM

BACKGROUND OF THE INVENTION

1. Technical Field

The present invention relates to a method for making an album, and more especially, to a method for making an album in an automatic way.

2. Description of Related Art

The methods for making an album are now largely classified into two types: manual and mechanical.

The Manual method includes two dominant processes:

The first process is to use white cardboard made of acetic acid resin as an interlayer. The specific process flow is as shown in FIG. 1. In this process, a sizing machine, a creasing machine and an auxiliary machine for pressing and others are adopted. White cardboard and acetic acid resin are used as consumables.

Firstly, apply acetic acid resin on the white cardboard with the same specifications for the album by means of the sizing machine, bond it with the photo properly, sufficiently dry the board after the photos are bonded, and then crease the boards in the middle one by one by the creasing machine, fold the board manually, apply the adhesive on the back of the board, align it by referring to the middle seam and bond them well back to back, press and dry it as a whole for 1 day; after being flattened, trim the three edges (except the middle seam) to complete the making of the album core, afterwards, add ornaments such as an ironed edge, stick the cover to finish making an album.

The second process is to use PVC with the self-adhesive pre-coated as an interlayer. The specific process flow is as shown in FIG. 2. In this process, a manual creasing machine, a cutter and an auxiliary machine for pressing and others are adopted. The PVC sheets with the self-adhesive pre-coated on both sides in different specifications are as consumables.

Firstly, crease a photo in the middle seam, fold it manually; and then pull away the protective film on one surface of the PVC sheet, from the middle seam, make an alignment, flatten the film manually and attach the photo properly while removing, afterwards, remove the film on the other side and attach the second photo back to back by the same method; while completing adhesion, press it flat and trim the three edges (except the middle seam), add ornaments on the edges like ironing, afterwards, stick the cover to finish making an album.

The Mechanical method also has two processes mainly:

The first process is semi-auto hot pressing method. The process chart is as shown in FIG. 3. In this process, a machine integrating functions such as creasing, hot-sealing of the middle seam and hot-sealing of the entire album is adopted. The PVC sheet or white cardboard with pressure-sensitive the adhesive coated on both sides is used as consumables. The PVC protective film along with the machine is provided to prevent bonding between two pieces of the album paper at a high temperature.

Crease a photo in the middle seam area, fold it properly and put it aside; apply pressure-sensitive the adhesive between the backs of the photos, insert the PVC protective film between the photos, make an alignment by referring to the middle seam and ensure the tidiness; put the middle seam of the album into the hot-sealing middle seam area for pressing for 4 minutes, and then put the whole album at a horizontal level into the album a hot-sealing area for pressing at a temperature of about 100° C. for about 10 minutes; after completion, take out the album and put it in a cooling area for flattening and cooling for about 10 minutes; remove the PVC film, trim the three edges (except the middle seam), select ornaments like an ironed edge and then stick the cover to finish making an album.

The second process is automatic hot-melt adhesive sealing without an interlayer. The process flow is as shown in FIG. 4. In this process, a three-in-one machine integrating cutting, creasing and folding, an automatic album forming machine and a three-edge cutter are adopted. The hot melt adhesive is the only consumable.

Firstly, place the album paper developed in the entire film onto the three-in-one machine integrating cutting, creasing and folding, the machine then automatically performs creasing and folding to get a stack of photos properly folded; afterwards, put the stack of photos into the automatic album forming machine manually, then the machine will automatically perform sizing, pasting and so on, in this way, rapidly making an album core without an interlayer. Put the core into a three-edge cutter for automatic cutting and stick the cover to form an album.

The process of using white cardboard made of acetic acid resin as an interlayer has the disadvantages of a long processing period due to the fully manual operation, airtightness and insufficient dryness of acetic acid resin bonded with the album paper, deformation after dampening and the thick single-page of an album.

The process using PVC with the self-adhesive pre-coated as an interlayer and semi-auto hot pressing method has a shorter processing period, but a larger amount of manual operation is still required. Moreover, the consumables are high in cost and the self-adhesive pre-coated on the PVC is prone to deteriorate, thus it is apt to lead to album foaming and deformation.

The disadvantages of the process by automatic hot-melt adhesive sealing without an interlayer include: the machine has no interlayer function, an additional creasing, folding and pasting machine must be provided, it is designed to fit for continuous development and printing, namely, those requiring the development and printing of the entire film only, so the three-in-one machine integrating automatic cutting, creasing and folding is not compatible with other printing machines.

Moreover, there is a common disadvantage in the processes above, that is, it is impossible to exchange between the use of an interlayer and the skip of an interlayer, and that is to say, the equipment can be used to make an album with or without the interlayer permanently, incapable of being changed flexibly at the customer's desire.

BRIEF SUMMARY OF THE INVENTION

In view of the disadvantages in the prior art, the present invention aims at providing a method for making an album in a full-automatic way with high automation degree and flexible selection of the album making types.

To realize the purpose above, the present invention provides the technical solution below: a method for making an album in a full-automatic way, comprising the steps below:

a. Feed the album paper into a creasing machine piece by piece; b. crease the album paper in the middle by the creasing machine, and then transfer the album paper with a crease to a folding mechanism; c. fold the album paper along the crease by the folding mechanism, wherein the printed side of the album paper is on the interior side after the folding and the album paper folded is transferred to the pasting mechanism for the automatic bonding; d. when the command requires that the album is made to be without an interlayer, the pasting mechanism performs the automatic pasting process of Step e, otherwise performs the automatic pasting process of Step f; e.

apply the adhesive on one external side of the album paper folded and transferred by the pasting mechanism, paste it with the other external side of the previous piece of the album paper that is without the adhesive coating, make the two pieces of the paper align with each other exactly, and so forth, so that all the album paper is bonded to form the album core;

f. feed the album paper folded and the interlayer alternately into the pasting mechanism, apply the adhesive on one side of the interlayer by the pasting mechanism, paste it with the other external side of the previous piece of the album paper entering into the pasting mechanism, apply the adhesive on one external side of the next piece of the album paper entering into the pasting mechanism, paste it with the other side of the interlayer, make all bonding surfaces of the album paper and the interlayer align exactly, transfer another piece of the interlayer, and so forth, so that all the album paper and the interlayer are bonded alternately to form the album core.

After Step e and f, Step g is further included, namely, the album core is fed into a cutter, after the alignment and the positioning, the three edges (except the album paper crease of the album core) are trimmed.

After Step g, Step h is further included, namely, apply the adhesive on the upper and lower side of the album core by the pasting mechanism, paste the cover with the upper and lower sides of the album core, the spine of the cover and the album paper crease are on the same side, just opposite the album flanging.

In Step h, the cover is made of hard paper board, album paper, leather or artificial leather materials.

In Step d, Process e or f is controlled by a microcomputer according to the album making command; when Process e is selected, the microcomputer controls the album paper feeding mechanism to transfer the album paper to the pasting mechanism; when Process f is selected, the microcomputer controls the album paper feeding mechanism and the interlayer feeding mechanism to transfer the album paper and the interlayer alternately to the pasting mechanism.

In Step c, the folding mechanism takes the crease in the middle of the album paper as the pivot to fold the album along one end of the album paper toward the other end of the album, roll and bond the folded surface to form the folding of the album paper.

In Step c, the folding mechanism draws the middle crease of the album paper between two rollers by means of the rollers interacted with each other, and performs pressing and folding.

In Step e and f, the pasting mechanism absorbs the album paper or the interlayer by means of the absorption cylinder, drives it to the sizing mechanism location to apply the adhesive on one side of the album paper or the interlayer; when the absorption cylinder rotates to the lower limit, driven by the driving mechanism, the platform is raised, the linear speed of the cylinder is consistent with the moving speed of the platform, the platform and the cylinder press and paste the album paper and the album paper with an interlayer.

The adhesive coated on the side of the album paper or the interlayer is hot melt adhesive, the printing unit of the album paper forms an imaging unit by means of halogen silver printing, laser printing or ink jet, the interlayer is thin plastic sheet or cardboard.

In Step f, there are multiple types of the interlayers available and different interlayers can be selected for feeding the pasting mechanism according to the commands.

Comparing with the prior art, the present invention improves the conventional album making process, adopts double feeding mechanisms in feeding procedure, namely album paper feeding mechanism and the interlayer feeding mechanism, and uses the automatic control system to perform determination and selection of one feeding structure, so as to make an album with or without an interlayer according to the customer's demand, in this way, realizing automatic control in the whole process, removing the defect requiring manual operation for adding interlayer or incapable of flexibly changing between adding or reducing the interlayer, thus improving the automation degree and production efficiency of album making process.

DETAILED DESCRIPTION OF THE INVENTION

The present invention is further detailed in combination with the drawings.

Figure 1:
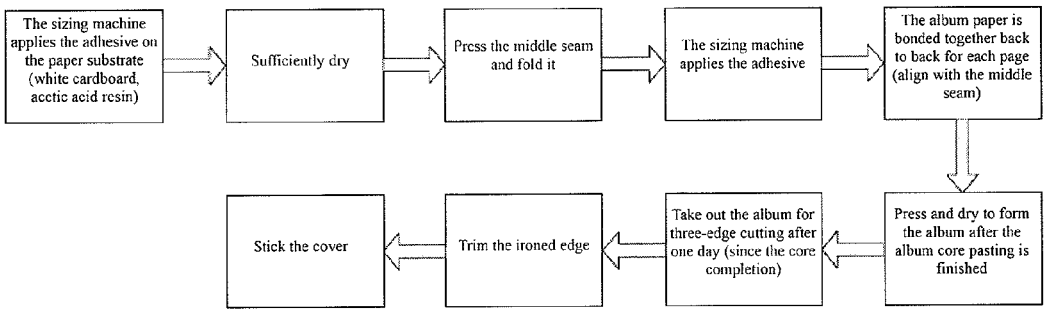
FIG. 1 is the flow chart of the process using the white cardboard made of acetic acid resin as an interlayer in the prior art.
Figure 2:
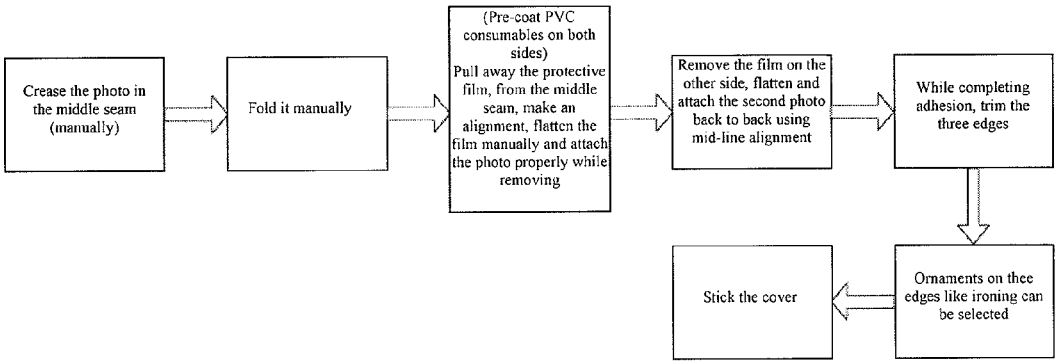
FIG. 2 is the flow chart of the process using PVC with the self-adhesive pre-coated as an interlayer in the prior art.
Figure 3:
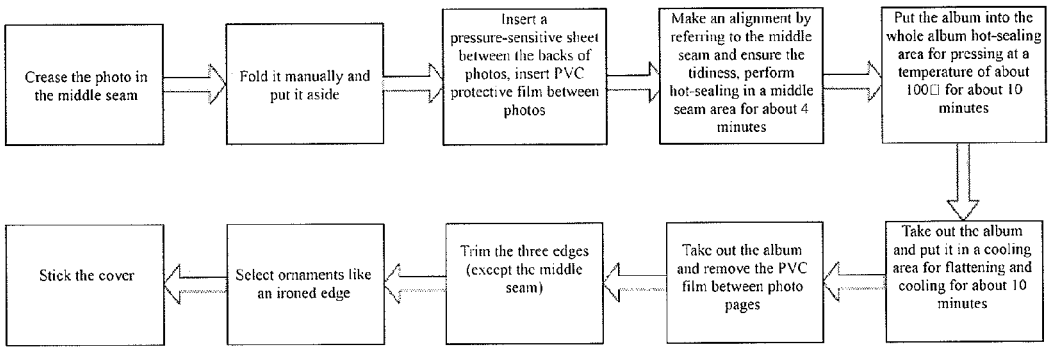
FIG. 3 is the flow chart of semi-automatic hot-pressing process in the prior art.
Figure 4:
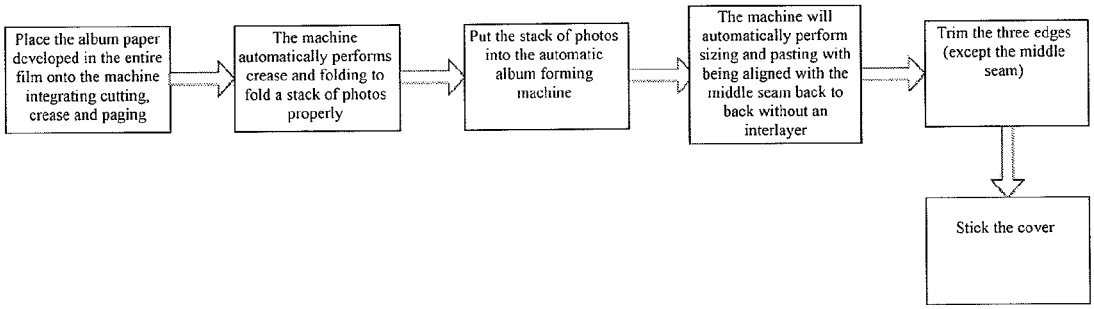
FIG. 4 is the flow chart of the automatic hot-melt adhesive pressing process without an interlayer provided in the prior art.
Figure 5:
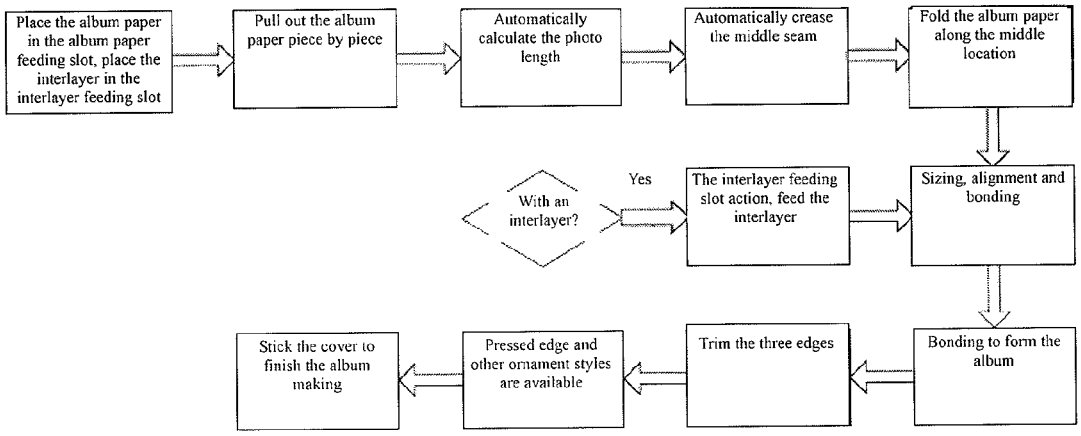
FIG. 5 is the flow chart of the method for making an album in a full-automatic way in the present invention.
Figure 6:
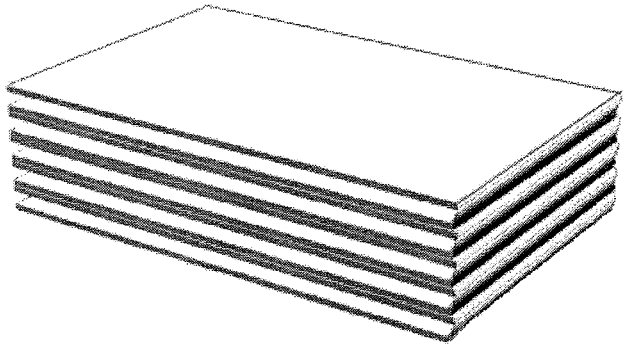
FIG. 6 is the schematic view of the structure for the album without an interlayer.
Figure 7:
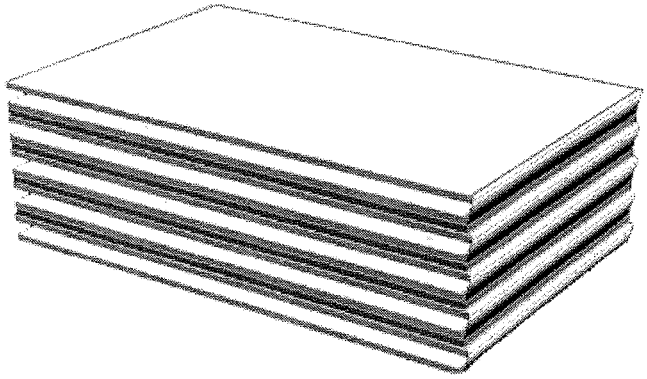
FIG. 7 is the schematic view of the structure for the album with an interlayer.

As shown in FIGS. 5 to 7, a method for making an album in a full-automatic way is provided. The method adopts the following equipment: an album paper feeding mechanism, an interlayer feeding mechanism, a microcomputer controlling the two mechanisms, a pasting mechanism and an edge cutter, wherein the album paper feeding mechanism connects the album feeding slot, the paging mechanism, the creasing machine and the folding machine in a proper order, the interlayer feeding mechanism includes an album feeding slot and a paging mechanism linked in sequence, the method includes the steps below:

a. Feed the album paper printed into the creasing machine piece by piece;

The printing unit of the album paper forms an imaging unit by an album laser printing device or an album ink jet device or the halogen silver printing method. Multiple pieces of the album paper are placed into the album feeding slot of the device from top to bottom, and multiple interlayers are also put into the interlayer feeding slot of the device from bottom to top. To feed the album paper, the paging mechanism on the album feeding slot draws the album paper from top to bottom piece by piece. Similar to the adoption of the album feeding slot, the interlayers on the interlayer feeding slot are also pulled out piece by piece from top to bottom.

b. Crease the album paper in the middle by the creasing machine, and then transfer the album paper with a crease to the folding mechanism;

In the present invention, the creasing machine automatically calculates the length of the album paper through a testing device, and transfers the middle location of the album paper just beneath the pressing mechanism of the creasing machine to press the album paper for a crease.

c. Fold the album paper along the crease by the folding mechanism, wherein the printed side of the album paper is on the interior side after the folding and the album paper folded are transferred to the pasting mechanism for the automatic bonding;

While folding, firstly position the middle location of the album paper, fold the album paper along the middle location. Two processes are included: the first process is to draw the middle crease of the album paper between the rollers by means of two rollers interacted with each other for rolling and folding. When the crease of the album paper is in the feeding location of the two rollers, since the crease location is slightly lower than the overall plane of the album paper, the roller will utilize the crease location to make the entire album paper roll into the two rollers for rolling. The second process is to take the crease in the middle of the album as the pivot to fold the album along one end of the album paper toward the other end of the album by means of a folding mechanism, roll the folded surface to form the folding of the album paper.

d. When the command requires that the album is made to be without an interlayer, the pasting mechanism performs the automatic pasting process of Step e, otherwise performs the automatic pasting process of Step f; this album making command can be completed by manually controlling the microcomputer or an automatic control process.

e. Apply the adhesive on one external side of the album paper folded and transferred by the pasting mechanism piece by piece, paste it with the other external side of the previous piece of the album paper that is without the adhesive coating, make the two pieces of the paper align with each other exactly, and so forth, so that all the album paper is bonded to form the album core; wherein, the first album paper is not coated with the adhesive.

f. Feed the album paper folded and the interlayer alternately into the pasting mechanism, apply the adhesive on one side of the interlayer by the pasting mechanism, paste it with the other external side of the previous piece of the album paper entering into the pasting mechanism, apply the adhesive on one external side of the next piece of the album paper entering into the pasting mechanism, paste it with the other side of the interlayer, make all bonding surfaces of the album paper and the interlayer aligned exactly, transfer another piece of the interlayer, and so forth, so that all album paper and the interlayer are bonded alternately to form the album core.

Wherein: Step e and Step f are controlled by the microcomputer according to the commands. When Process e is selected, the microcomputer controls the album paper feeding mechanism to transfer the album paper to the pasting mechanism piece by piece; when Process f is selected, the microcomputer controls the album paper feeding mechanism and the interlayer feeding mechanism to transfer the album paper and the interlayer alternately to the pasting mechanism.

After Step e and f, Step g is further included, namely, the album core is fed into a cutter, after the alignment and the positioning, the three edges except the album paper crease of the album core are trimmed. After trimming, the three edges can be decorated by ironing so that the album core looks more attractive.

After Step g, Step h is further included, namely, apply the adhesive on the upper and lower side of the album core by the pasting mechanism, paste the cover with the upper and lower sides of the album core, the spine of the cover and the album paper crease are on the same side, just opposite to the album flanging. The cover is made of hard paper board, album paper, leather or artificial leather materials. The leather materials and hard paper board covers are customized goods finished in advance. The cover shows the photo directly printed with the length slightly more than the album core. Three creases are pressed in the middle and aligned by referring to the middle crease of the album core. Afterwards, stick the cover by a double-sided tape firmly.

In Step d, Process e or f is controlled by the microcomputer according to the command; when Process e is selected, the microcomputer controls the album paper feeding mechanism to transfer album paper to the pasting mechanism piece by piece; when Process f is selected, the microcomputer controls the album paper feeding mechanism and the interlayer feeding mechanism to transfer the album paper and the interlayer alternately to the pasting mechanism.

In Step e and f, the pasting mechanism includes an absorption cylinder connected with the folding mechanism, a sizing mechanism set on one side of the absorption cylinder, a platform beneath the absorption cylinder, and a driving mechanism connected with the absorption cylinder and the platform capable of moving up and down. The absorption cylinder consists of the absorption mouth for absorbing the album paper or the interlayer, a vacuum pipe connected with the absorption mouth and an evacuation system connected to the vacuum pipe. The pasting mechanism absorbs the album paper or the interlayer by means of the absorption cylinder, drives it to the sizing mechanism location to apply the adhesive on one side of the album paper or the interlayer. When the absorption cylinder rotates to the lower limit, driven by the driving mechanism, the platform is raised, the linear speed of the cylinder is consistent with the moving speed of the platform, the platform and the cylinder perform pressing and pasting to the album paper and the album paper with an interlayer.

The adhesive coated on the side of the album paper or the interlayer is hot melt adhesive. The interlayer is thin plastic sheet or cardboard, wherein the thickness of the interlayer is determined according to the requirements of the album specifications, generally from 0.1 to 0.3 mm. With an interlayer, the album pages become flatter and harder with better substantial texture while opening the album and are not prone to be deformed in damp condition.

In Step f, to provide multiple types of the interlayers made of different materials in the album making, multiple interlayer feeding slots are set for the interlayer feeding mechanism and different interlayers are selected for feeding into the pasting mechanism according to the commands.

What is claimed is:

1. A method for making an album, comprising steps of:

(a). providing album paper and interlayers piece by piece;

(b). creasing one piece of the album paper in the middle to form a crease;

(c). folding the piece of the album paper along the crease, wherein a printed side of the piece of the album paper faces inside after the folding;

(d). when the album is to be made without an interlayer, performing step (e), otherwise performing step (f);

(e). applying adhesives on an external side of the piece of the album paper folded, pasting it with the other the external side of the piece of the album paper folded to an external side of a previous piece of the album paper having no adhesive, aligning the two pieces of the album paper with each other exactly, so that all the album paper is bonded to form a album core;

(f). applying adhesives on one side of an interlayer, pasting the side of the interlayer to an external side of a piece of the album paper, applying adhesives on an external side of a next piece of the album paper, pasting the external side of the next piece of the album paper to the other side of the interlayer, aligning the album paper and the interlayer exactly, so that all the album paper and the interlayers are bonded alternately to form a album core.

2. The method for making an album according to claim 1, further comprising a step of:

(g) trimming edges of the album core after the album core is aligned and positioned, except for the edge formed by the album paper crease.

3. The method for making an album according to claim 2, further comprising a step of:

(h) applying adhesives on an upper and lower sides of the album core, pasting a cover to the upper and lower sides of the album core, with a spine of the cover and the album paper crease being on the same side and opposite to an opening side of the album core.

4. The method for making an album according to claim 3, wherein the cover in step (h) is made of hard paper board, album paper, leather or artificial leather materials.

5. The method for making an album according to claim 1, wherein when step (e) is selected to perform, feeding only the album paper for applying adhesives; when step (f) is selected to perform, alternatively feeding the album paper and the interlayers for applying adhesives.

6. The method for making an album according to claim 1, wherein in step (c), the folding is carried out by taking the crease in the middle of the album paper as a pivot to fold one end of the album paper towards the other end of the album paper, and then pressing on the album paper until the album paper is completely folded.

7. The method for making an album according to claim 1, wherein in step (c), the folding is carried out by rolling on the album paper at both sides of the crease until the album paper is completely folded.

8. The method for making an album according to claim 1, wherein the adhesives are hot melt adhesives, and the printed side of the album paper has images formed by means of halogen silver printing, laser printing or ink jet, and the interlayers are thin plastic sheet or cardboard.

9. The method for making an album according to claim 1, wherein in step (f), multiple types of the interlayers are available and can be selected as needed.

* * * * *